US007999766B2

(12) United States Patent
Okamoto et al.

(10) Patent No.: US 7,999,766 B2
(45) **Date of Patent: *Aug. 16, 2011**

(54) PLASMA DISPLAY PANEL DRIVING METHOD, PLASMA DISPLAY PANEL DRIVER CIRCUIT, AND PLASMA DISPLAY DEVICE

(75) Inventors: Sohei Okamoto, Izumi (JP); Takatoshi Shoji, Izumi (JP); Hiroshi Shirasawa, Izumi (JP)

(73) Assignee: Panasonic Corporation, Osaka (JP)

( * ) Notice: Subject to any disclaimer, the term of this patent is extended or adjusted under 35 U.S.C. 154(b) by 780 days.

This patent is subject to a terminal disclaimer.

(21) Appl. No.: 12/030,900

(22) Filed: Feb. 14, 2008

(65) Prior Publication Data

US 2008/0136747 A1 Jun. 12, 2008

Related U.S. Application Data

(63) Continuation of application No. 11/001,037, filed on Dec. 2, 2004, now Pat. No. 7,355,567.

(30) Foreign Application Priority Data

Dec. 4, 2003 (JP) ..... 2003-406560

(51) Int. Cl.
*G09G 3/28* (2006.01)

(52) U.S. Cl. ..... 345/60; 345/67; 315/169.1

(58) Field of Classification Search ..... 345/60–68, 345/76–83; 315/169.1–169.4
See application file for complete search history.

(56) References Cited

U.S. PATENT DOCUMENTS

| | | | | |
|---|---|---|---|---|
| 7,173,578 | B2 | 2/2007 | Kim et al. | |
| 7,355,567 | B2 * | 4/2008 | Okamoto et al. | 345/60 |
| 2003/0076284 | A1 | 4/2003 | Onozawa et al. | |
| 2003/0169216 | A1 | 9/2003 | Chung et al. | |
| 2003/0214463 | A1 | 11/2003 | Lim et al. | |

FOREIGN PATENT DOCUMENTS

| | | |
|---|---|---|
| JP | 11-065516 | 3/1999 |
| JP | 2000-194320 A | 7/2000 |
| JP | 2002-140032 | 5/2002 |

* cited by examiner

*Primary Examiner* — Kimnhung Nguyen
(74) *Attorney, Agent, or Firm* — Sughrue Mion, PLLC

(57) ABSTRACT

A driving method and a driver circuit for improving the definition of display image on a plasma display device. In an initial state in an addressing discharge period, a scanning electrode is applied with a scanning base pulse at a first power supply potential. This suppresses a weak erroneous discharge between a scanning base pulse and a display data pulse. Next, the scanning electrode is applied with a scanning pulse. After the scanning pulse has been applied, the scanning electrode is applied with the scanning base pulse at a second power supply potential. In this way, the level of the scanning base pulse applied to the scanning electrode after the end of the application of the scanning pulse in the addressing discharge period is lower than the level of the scanning base pulse applied to the scanning electrode before the application of the scanning pulse. This ensures a potential difference between the scanning electrode and the sustain electrode, and facilitates the formation of a wall charge required for a sustain discharge in the next discharge sustain period.

10 Claims, 12 Drawing Sheets

PLASMA DISPLAY PANEL DRIVING METHOD, PLASMA DISPLAY PANEL DRIVER CIRCUIT, AND PLASMA DISPLAY DEVICE

CROSS-REFERENCE TO RELATED APPLICATIONS

This is a continuation of U.S. application Ser. No. 11/001,037, filed Dec. 2, 2004, which is incorporated herein by reference in its entirety.

BACKGROUND OF THE INVENTION

1. Field of the Invention

The present invention relates to a plasma display panel driving method, a plasma display panel driver circuit, and a plasma display device, and more particularly, to a plasma display panel driving method, a plasma display panel driver circuit, and a plasma display device which are suitable for use when a high definition of display image is required.

2. Description of the Related Art

Plasma display devices mainly comprising a plasma display panel (PDP) are advantageous over conventionally widespread displays such as CRT (Cathode Ray Tube), liquid crystal displays, and the like in many aspects including a thin profile, a flickering-free feature, a large display contrast ratio, the ability to provide relatively large screens, a high response speed, the ability to emit multiple colors by use of selfluminous fluorescent materials, and the like. For this reason, the plasma display devices are being widely employed in recent display devices for use with computers, color image display devices, and the like.

The plasma display devices are classified into an AC type which has electrodes (scanning electrodes, discharge sustain electrodes, and data electrodes) covered with a dielectric layer, and is indirectly operated in an alternating current discharge state, and a DC type which has electrodes exposed to a discharge space and is operated in a direct current discharge state. The AC type plasma display devices are further classified into a memory operation type which utilizes memories of display cells for its driving, and a refresh operation type which does not utilizes such memories. The luminance of a plasma display device is proportional to the number of times of discharges, i.e., the number of repetitions of pulse voltages. The foregoing refresh type is mainly used for a plasma display device having a small display capacity because its luminance is lower as the display capacity is larger.

Next, a representative structure of the AC type PDP will be described.

This type of PDP, for example, as shown in FIG. 1, comprises a front substrate (first substrate) 1 and a back substrate (second substrate) 2 disposed in opposition to each other, and a discharge gas space 3 formed between these substrates. The front substrate 1 comprises a first insulating substrate 4, a scanning electrode 5, a discharge sustain electrode (also referred to as a "common electrode," and hereinafter called the "sustain electrode") 6, a discharge gap 7, a dielectric layer 8, and a protection layer 9. The first insulating substrate 4 is made of a transparent material such as soda line glass or the like. The scanning electrode 5 and sustain electrode 6 are disposed in parallel to each other in a row direction H on the inner surface of the first insulating substrate 4, and are also formed opposite to each other across the discharge gap 7, to make up a pair of row electrodes (i.e., surface discharge electrode pair).

The scanning electrode 5 is comprised of a transparent electrode 5A and a bus electrode (trace electrode) 5B. The transparent electrode 5A is made of ITO (Indium Tin Oxide, transparent conductive thin film) or the like. The bus electrode 5B is made of a metal material such as Al (aluminum), Cu (copper), Ag (silver), or the like, and is formed to overlap a portion of the transparent electrode 5A for reducing the resistance of the transparent electrode 5A. The sustain electrode (common electrode) 6 in turn is comprised of a transparent electrode 6A and a bus electrode (trace electrode) 6B. The transparent electrode 6A is made of ITO or the like, similar to the transparent electrode 5A, while the bus electrode 6B is made of a metal material similar to that of the bus electrode 5B, and is formed to overlap a portion of the transparent electrode 6A for reducing the resistance of the transparent electrode 6A. The dielectric layer 8 is made of lead containing flint glass or the like for covering the scanning electrode 5 and sustain electrode 6. The protection layer 9, which is made of MgO (magnesium oxide) or the like, protects the dielectric layer 8 from a discharge.

On the other hand, the back substrate 2 comprises a second insulating substrate 12, a data electrode (also called the "address electrode") 13, a dielectric layer 14, partitions 15, and a fluorescent material layer 16. The second insulating substrate 12 is made of a transparent material such as soda lime glass or the like. The data electrode 13 is made of Al (aluminum), Cu (copper), Ag (silver), or the like, and is formed in a column direction V perpendicular to the row direction H on the inner surface of the second insulating substrate 12. The dielectric layer 14 is made of lead containing flint glass or the like for covering the data electrode 13. The partitions 15, which are made of lead containing flint glass or the like, are formed in the column direction V for defining respective display cells. Then, the discharge gas space 3 is ensured by the partitions 15, such that a single or a mixture of discharge gases such as He (helium), Ne (neon), Xe (xenon) and the like is filled in the discharge gas space 3. The fluorescent material layer 16 is formed over regions which cover the bottom surfaces and wall surfaces of the partitions 15, and is divided into a red fluorescent material layer, a green fluorescent material layer, and a blue fluorescent material layer for converting ultraviolet rays generated by discharging the discharge gas into visible light P. Then, the display cells as shown in FIG. 1 are arranged in the row direction H and column direction V in a matrix form to provide the PDP 10.

The front substrate 1 and back substrate 2 are fixed in opposition to each other across a gap of approximately 100 μm, and have their peripheries hermetically sealed by a sealing material. The second insulating substrate 12, which forms part of the back substrate 2, is formed with a vent hole at a predetermined location, and a ventilation pipe, not shown, is attached to the outer surface of the insulating substrate 12 in alignment to the vent hole under a hermetically sealed state. The end of the ventilation pipe opposite to the end attached to the insulating substrate 12 is initially opened, such that the ventilation pipe is connected to an evacuation/gas filling device. Then, after the discharge gas space is evacuated to a vacuum by the evacuation/gas filling device, a discharge gas is filled into the discharge gas space. After the discharge gas has been filled, the ventilation pipe is chipped on by overheating to close the open end. In this way, the discharge gas space is filled with the discharge gas to complete the PDP 10. In the plasma display device which mainly comprises the PDP 10 as described above, one pixel is comprised of three display cells (red: R, green: G, and blue: B display cells) for a color display, while one pixel is comprised of one display cell for a monochrome display.

FIG. 2 is a diagram showing the layout of the electrodes of the PDP 10 which make up a main portion of an AC memory operation plasma display device of three-electrode surface discharge type.

As shown in FIG. 2, in this PDP 10, pairs of row electrodes comprised of scanning electrodes 21 ($\mathbf{5}_1$, $\mathbf{5}_2$, $\mathbf{5}_3$, . . . , $\mathbf{5}_n$) and sustain electrodes 22 ($\mathbf{6}_1$, $\mathbf{6}_2$, $\mathbf{6}_3$, . . . , $\mathbf{6}_n$) (common electrodes) run in parallel with one another in the row direction H on the inner surface of the front substrate 1 in FIG. 1. Also, column electrodes comprised of data electrodes 23 ($\mathbf{13}_1$, $\mathbf{13}_2$, $\mathbf{13}_3$, . . . , $\mathbf{13}_m$) (address electrodes) run in the column direction V on the inner surface of the back substrate 2 such that they are perpendicular to the row electrodes. Then, display cells 24, . . . , 24 are formed at respective intersections of these row electrodes with the column electrodes. The display cells 24, . . . , 24 are arranged in the row direction H and column direction V in a matrix form, and one display cell 24 has one each of the scanning electrode 21, sustain electrode 22, and data electrode 23. Therefore, the total number of display cells which make up one screen of the PDP 10 amounts to nm, where n is the number of pairs of row electrodes comprised of the scanning electrodes 21 and sustain electrodes 22, and m is the number of column electrodes comprised of the data electrodes 23.

FIG. 3 is a diagram for explaining the principle of a gradation display method used in the PDP 10 of FIG. 1. The horizontal axis represents the time, while the vertical axis represents numbers, not shown, of the scanning electrodes in the PDP.

As shown in FIG. 3, in the PDP 10, one frame period (for example, 16.7 ms, and also referred to as "one TV field") is divided into eight sub-fields SF1, SF2, . . . , SF8 which are weighted based on gradation levels, and these sub-fields are further divided into an addressing discharge period (also referred to as the "scanning period") and a discharge sustain period. Shading in each addressing discharge period represents a timing at which a scanning pulse is applied to each scanning electrode. When the scanning pulse and a display data pulse applied to the data electrode are added simultaneously, a write discharge is produced. A patterned portion (discharge sustain period) in FIG. 3 represents a period in which the display cells emit light for display.

In these discharge sustain periods, a discharge sustain pulse is alternately applied to the scanning electrode and sustain electrode. A discharge cell in which a discharge is produced during an addressing discharge period emits light at an intensity in accordance with the length of the discharge sustain period. Since the eight discharge sustain periods in FIG. 3 have their lengths in a ratio of 1:2:4:8:16:32:64:128, an image in 256 gradation levels (0-255) is displayed by combining light emissions in these discharge sustain periods. Also, the overall luminance is determined in an associated sub-field by the number of the discharge sustain pulses in the discharge sustain period. The number of times of light emissions in the overall discharge sustain period is increased as the discharge sustain pulse has a higher frequency in the discharge sustain period, resulting in a higher light emission luminance. However, as the frequency of light emission pulses is higher, the PDP 10 consumes more power.

FIG. 4 is a diagram showing exemplary driving waveforms in one sub-field in FIG. 3. In periods 1-5, a variety of driving pulses are applied to any electrodes. In the following, the PDP driving operation will be described with reference to FIG. 4.

Period 1 is a priming period Tp in which a priming discharge is produced for helping produce discharges in all display cells without fail. In the priming period Tp, the scanning electrode 5 is applied with a positive saw-tooth priming pulse Ppr-s, while the sustain electrode 6 is simultaneously applied with a negative rectangular priming pulse Ppr-c, resulting in a priming discharge produced in a discharge space near an electrode gap (discharge gap 7) between the scanning electrode 5 and sustain electrode 6 in each and every display cell to generate active particles for helping produce the discharge in the display cells. Then, negative and positive wall charges stick to the scanning electrode 5 and sustain electrode 6, respectively. The priming pulse Ppr-s has a peak value equal to a priming voltage Vp, while the priming pulse Ppr-c has a peak value equal to a ground level. The priming discharge in this event involves producing a faint discharge at the time a discharge start voltage is exceeded by a potential difference between the priming pulses Ppr-s and PPr-c applied to the scanning electrode 5 and sustain electrode 6, respectively, and repeating the faint discharges to exhibit a weak discharge form.

Period 2 is a priming erasure period Tpe in which a priming erasure discharge is produced for reducing the wall charges sticking on the scanning electrode 5 and sustain electrode 6. If the all charges remain as sticking in the priming period Tp (period 1), a sustain discharge can be produced in the next discharge sustain period Tc even in those discharge cells (display cells which should not be essentially displayed) in which a write discharge (also referred to as an "addressing discharge") is not produced in the next addressing discharge period Tp (period 1), possibly resulting in an erroneous display. Therefore, the priming erasure period Tpe is provided in order to prevent the erroneous display as mentioned. In the priming erasure period Tpe, the scanning electrode 5 is applied with a negative saw-tooth priming erasure pulse Ppe-s which slowly falls, causing the wall charge to decrease as mentioned above. The priming erasure pulse Ppe-s presents a waveform which slowly decreases in the negative direction toward the scanning electrode 5. The priming erasure pulse Ppe-s has a peak value equal to a priming erasure voltage Vpe.

Period 3 is an addressing discharge period Ts in which a write discharge is produced for selecting display cells. In the addressing discharge period Ts, the scanning electrode 5 is applied with a scanning base pulse Pb, and is also applied with a negative rectangular scanning pulse Psc which falls down from the potential of the scanning base pulse Pb. Simultaneously, the data electrode 13 is applied with a positive rectangular display data pulse Pd, causing a write discharge to be produced in selected discharge cells. After the end of the scanning pulse Psc, a positive charge sticks to the scanning electrode 5, while a negative charge sticks to the sustain electrode 6 by the scanning base pulse Pb in display cells which emit light in a subsequent discharge sustain period. The scanning pulse Psc has a peak value equal to the ground level, while the display data pulse Pd has a peak value equal to the data voltage Vd. The write discharge is produced only at an intersection of the scanning electrode 5 applied with the scanning pulse Psc with the data electrode 13 applied with the display data pulse Pd. Then, wall charges stick to display cells in which the write discharge was produced, while no wall charges stick to display cells in which the write discharge was not produced.

Period 4 is a discharge sustain period Tc, in which a sustain discharge is produced for displaying only those display cells in which the write discharge was produced. In the discharge sustain period Tc, the sustain electrode 6 and scanning electrode 5 are alternately applied with positive rectangular sustain pulses Psus-c and Psus-s, respectively, from the sustain electrode 6 to repeatedly produce the sustain discharges. The sustain pulse Psus-c has a peak value equal to a sustain voltage Vs, while the sustain pulse Psus-s has a peak value equal to the ground level. In this event, since wall charges remain sticking in discharge cells in which the write discharge was produced in the addressing discharge period Ts, the sustain discharge is produced at the time a discharge start voltage is exceeded by a sum voltage of the wall charge voltage caused by the wall charge and a voltage caused by the positive sustain pulse Psus-c (applied first to the sustain electrode 6 as mentioned above). When the sustain discharge is produced, a wall charge sticks to cancel out the voltages applied to the sustain electrode 6 and scanning electrode 5. Consequently, negative and positive wall charges stick to the sustain electrode 6 and scanning electrode 5, respectively. Then, since the positive sustain pulse Psus-s is next applied to the scanning electrode 5, a sustain discharge is produced at the time the discharge start voltage is exceeded by a sum voltage of the voltage caused by the sustain pulse Psus-s and the voltage caused by the wall charge. Subsequently, such sustain discharges are repeated. The luminance level of the PDP is determined by the number of times of the sustain discharges in the discharge sustain period Tc.

Period 5 is a sustain erasure period Tce in which a sustain erasure discharge is produced for reducing the wall charges sticking on the scanning electrode 5 and sustain electrode 6 in the discharge sustain period Tc. In the sustain erasure period Tce, the scanning electrode 5 is applied with a negative sawtooth sustain erasure pulse Pse-s which slowly falls down, causing the wall charge to decrease as mentioned above. The sustain erasure pulse Pse-s has a peak value equal to an erasure voltage Vpe. In the foregoing manner, the driving operation terminates in one sub-field, followed by a like driving operation in the next sub-field.

Other than the plasma display device described above, this type of techniques has been described, for example, in the following documents.

In a plasma display panel driving apparatus described in Laid-open Japanese Patent Application No. 11-65516 (page 6, FIG. 13) (Patent Document 1), a voltage applied to a scanning electrode gradually decreases in a write period when a discharge is produced to select discharge cells in which a sustain discharge is produced.

In a plasma display panel driving method described in Laid-open Japanese Patent Application No. 2002-140032 (page 4, FIGS. 1, 2), a potential applied to a scanning electrode during a write period is gradually reduced to compensate for an electric field in a discharge space, which has been lost due to a reduction in a wall charge during the write period, to realize a stable write discharge and a reduction in data voltage.

However, the conventional plasma display device described above has the following problems.

Specifically, the state of the wall charge within a cell immediately before the addressing discharge period Ts in FIG. 4 is such that a positive charge (+) deposits on the sustain electrode 6 and address electrode 13, while a negative charge (−) deposits on the scanning electrode 5, as shown in FIG. 5. During a write, the scanning electrode 5 is sequentially applied with the scanning pulse Psc, while the display data pulse Pd is applied only to the address electrode 13 which is positioned opposite to a location at which light is emitted in the appropriate scanning electrode 5. As a result, a discharge is produced between the scanning electrode 5 and addressing electrode 13 only in display cells which are applied with the two types of the aforementioned pulses, and this discharge triggers a discharge between the scanning electrode 5 and the sustain electrode 6 to form a wall charge required for a sustain discharge (a positive charge on the sustain electrode 5 and a negative charge on the sustain electrode 6), as shown in FIG. 6, causing the selected discharge cell to emit light during the discharge sustain period Tc.

On the other hand, as shown in FIG. 1, no wall charge required for the sustain discharge is formed in a display cell which is not applied with the display data pulse Pd. However, a scanning electrode which is scanned in a later turn by the scanning pulse Psc involves a longer time from the formation of the wall charge immediately before the addressing discharge period Ts shown in FIG. 4 to the application of the scanning pulse Psc, a weak erroneous discharge can be produced during this time between the scanning base pulse Pb and the display data pulse Pd output to select a display cell before the scanning line. In this event, as shown in FIG. 8, the negative charge on the scanning electrode 5 and the positive charge on the address electrode 13 are reduced to cause a shortage of the wall charges on both electrodes, possibly resulting in a failure of a write discharge between the scanning electrode 5 and address electrode 13, even if the scanning pulse Psc is applied, to lead to a resulting failure in the formation of the wall charge required for the sustain discharge and in light emission of the display cell.

The weak erroneous discharge produced between the scanning electrode 5 and the address electrode 13 is produced because active particles generated in Period 1 and Period 2 in FIG. 4 set up a state which facilitates a discharge. When a sustain discharge has been produced in the sub-field immediately before the sub-field concerned (preceding sub-field), the active particles generated in Period 1 and Period 2 are more activated to further facilitate the weak erroneous discharge. Since the active particles generated by the sustain discharge in the preceding sub-field increases as discharges are produced a larger number of times, the weak erroneous discharge is more likely to be produced between the scanning electrode 5 and the address electrode 13 when the sustain discharges are produced a larger number of times in the preceding sub-field. To prevent this state, the scanning base pulse Pb must be set at a higher voltage before the scanning pulse Psc is applied to the scanning electrode 5 in the addressing discharge period Ts, thereby making the weak erroneous discharge less likely to be produced.

On the other hand, in a display cell in which the scanning electrode 5 is applied with the scanning pulse Psc, and the address electrode 13 is applied with the display data pulse Pd, a sufficient potential difference must be ensured between the scanning electrode 5 and the sustain electrode 6 to form a wall charge required for a sustain discharge. Since the voltage applied to the sustain electrode 6 is always constant in the addressing discharge period Ts, the scanning base pulse Pb applied to the scanning electrode 5 must be set lower in order to form a sufficient wall charge for a sustain discharge. In this way, it is desired to vary the voltage of the scanning base pulse Pb before and after the application of the scanning pulse Psc applied to the scanning electrode 5 in the addressing discharge period Pb. With the scanning base pulse Pb set at a single voltage as before, a sufficient voltage setting margin cannot be ensured due to temperature-induced variations in a discharge voltage of the panel, resulting in limitations on a voltage range in which the scanning base pulse Pb can be set.

Furthermore, in cases where a drive waveform excluding the priming period Tp is utilized, the weak discharge between the scanning electrode and address electrodes in the previous subfield may not possibly be erased in the reset period of the subsequent subfield, resulting in a failure of light emission of the display cells in the subsequent field.

For example, as shown in FIG. 9, a limited range has been provided for setting the voltage of the scanning base pulse Pb. Specifically, since a discharge condition varies due to the temperature on the panel of the PDP 10, a lower limit (Vbw-min) of the voltage level of the scanning base pulse Pb is determined by a range in which the weak erroneous discharge is suppressed between the scanning electrode 5 and the address electrode 13 before scanning. An upper limit Vbw-man of the level of the scanning base pulse Pb, on the other hand, is determined by a range in which the formation of a wall charge required for the sustain electrode 6 after scanning is facilitated. Thus, the level of the scanning base pulse Pb can be set irrespective of the temperature on the panel in a narrow range (96-100 V) surrounded by a dotted line in FIG. 14, providing no margin for the setting range. A measure to this problem may be to control the level of the scanning base pulse Pb in response to the temperature on the panel, but is difficult to implement because the temperature on the panel differs from one display cell to another, and it is difficult to detect the varying temperature without delay. This results in a problem of a degraded definition in displayed images.

The plasma display driving apparatus described in Patent Document 1 differs from the present invention in the driving method because the voltage applied to the scanning electrode gradually decreases during a write period in Patent Document 1. Likewise, the plasma display panel driving method described in Patent Document 2 differs from the present invention in the driving method, because the voltage applied to the scanning electrode gradually decreases during a write period, as is the case with Patent Document 1.

SUMMARY OF THE INVENTION

To solve the foregoing problems, a first aspect of the present invention relates to a plasma display panel driving method for use with a plasma display panel comprising a first substrate and a second substrate disposed in opposition to each other; a plurality of surface discharge electrode pairs each comprised of a scanning electrode and a discharge sustain electrode disposed on a surface of the first substrate opposing the second substrate and extended in parallel with each other across a discharge gap; a plurality of address electrodes disposed on the surface of the second substrate opposing the first substrate in a form perpendicular to each of the surface discharge electrode pairs; and a plurality of display cells each formed at each of intersection areas of the plurality of surface discharge electrode pairs with the plurality of address electrodes. The method includes dividing one frame period of a display image displayed in gradations by the plurality of display cells into a plurality of sub-fields weighted based on gradation levels, and setting to each the sub-field an addressing discharge period for causing the display cell selected by sequentially applying a scanning pulse to each scanning electrode, and simultaneously applying a display data pulse synchronized with the scanning pulse to each of the address electrodes to generate an addressing discharge, and a discharge sustain period for alternately applying a discharge sustain pulse to each of the discharge sustain electrodes and each of the scanning electrodes to cause each of the display cells to emit light. The method is characterized by including a period for setting a potential of a second scanning base pulse applied to the scanning electrode after the end of the application of the scanning pulse lower than a potential of a first scanning base pulse applied to the scanning electrode before the application of the scanning pulse during the addressing discharge period.

A second aspect of the present invention relates to the plasma display panel driving method according to the first aspect of the present invention, and is characterized in that the potential of the first scanning base pulse is set at a level for preventing a weak erroneous discharge between the scanning electrode and the address electrode, and the potential of the second scanning base pulse is set at a level for forming a wall charge required for a sustain discharge at the discharge sustain electrode.

A third aspect of the present invention relates to the plasma display panel driving method according to the first or second aspect of the present invention, and is characterized in the potential of the first scanning base pulse or the potential of the second scanning base pulse is set at a different level for each of the sub-fields.

A fourth aspect of the present invention relates to the plasma display panel driving method according to the first, second or third aspect of the present invention, and is characterized in that a potential difference between the potential of the first scanning base pulse and the potential of the second scanning base pulse in the addressing discharge period in the next sub-field is varied based on a total number of the discharge sustain pulses in the discharge sustain period of the sub-field.

A fifth aspect of the present invention relates to the plasma display panel driving method according to the first, second, third or fourth aspect of the present invention, and is characterized in that the potential of the first scanning base pulse is set at a level for preventing a weak discharge between the scanning electrode and the address electrode, and the potential of the second scanning base pulse is set at a level for forming a wall charge required for a sustain discharge at the discharge sustain electrode, wherein the potential of said second scanning base pulse is set at the potential of said first scanning base pulse after a lapse of a constant period from a start of application of said scanning pulse.

A sixth aspect of the present invention relates to the plasma display panel driving method according to the first, second, third or fourth aspect of the present invention, and is characterized in that a period for holing said second scanning base pulse is set at a value between a horizontal scanning period and a period from a start of application of said second scanning base pulse before an end of the scanning period.

A seventh aspect of the present invention relates to a plasma display panel driver circuit for use with a plasma display panel comprising a first substrate and a second substrate disposed in opposition to each other; a plurality of surface discharge electrode pairs each comprised of a scanning electrode and a discharge sustain electrode disposed on a surface of the first substrate opposing the second substrate and extended in parallel with each other across a discharge gap; a plurality of address electrodes disposed on the surface of the second substrate opposing the first substrate in a form perpendicular to each of the surface discharge electrode pairs; and a plurality of display cells each formed at each of intersection areas of the plurality of surface discharge electrode pairs with the plurality of address electrodes. The plasma display panel driver circuit is operable to divide one frame period of a display image displayed in gradations by the plurality of display cells into a plurality of sub-fields weighted based on gradation levels, and set to each of the sub-fields an addressing discharge period for causing the display cell selected by sequentially applying a scanning pulse to each scanning electrode, and simultaneously applying a display data pulse synchronized with the scanning pulse to each of the address electrodes to generate an addressing discharge, and a discharge sustain period for alternately applying a discharge sustain pulse to each of the discharge sustain electrodes and each of the scanning electrodes to cause each of the display cells to emit light, and is characterized in that the plasma display panel driver circuit is configured to set a potential of a second scanning base pulse applied to the scanning electrode after the end of the application of the scanning pulse lower than a potential of a first scanning base pulse applied to the scanning electrode before the application of the scanning pulse during the addressing discharge period.

A eighth aspect of the present invention relates to the plasma display panel driver circuit according to the seventh aspect of the present invention, and is characterized in that the plasma display panel driver circuit is configured to set the potential of the first scanning base pulse at a level for preventing a weak erroneous discharge between the scanning electrode and the address electrode, and set the potential of the second scanning base pulse at a level for forming a wall charge required for a sustain discharge at the discharge sustain electrode.

A ninth aspect of the present invention relates to the plasma display panel driver circuit according to the seventh or eighth aspect of the present invention, and is characterized in that the plasma display panel driver circuit is configured to set the potential of the first scanning base pulse or the potential of the second scanning base pulse at a different level for each of the sub-fields.

A tenth aspect of the present invention relates to the plasma display panel driver circuit according to the seventh, eighth, or ninth aspect of the present invention, and is characterized in that the plasma display panel driver circuit is configured to vary a potential difference between the potential of the first scanning base pulse and the potential of the second scanning base pulse in the addressing discharge period in the next sub-field based on a total number of the discharge sustain pulses in the discharge sustain period of the sub-field.

A eleventh aspect of the present invention relates to a plasma display device which comprises a plasma display panel comprising a first substrate and a second substrate disposed in opposition to each other; a plurality of surface discharge electrode pairs each comprised of a scanning electrode and a discharge sustain electrode disposed on a surface of the first substrate opposing the second substrate and extended in parallel with each other across a discharge gap; a plurality of address electrodes disposed on the surface of the second substrate opposing the first substrate in a form perpendicular to each of the surface discharge electrode pairs; and a plurality of display cells each formed at each of intersection areas of the plurality of surface discharge electrode pairs with the plurality of address electrodes; and a driver circuit for dividing one frame period of a display image displayed in gradations by the plurality of display cells into a plurality of sub-fields weighted based on gradation levels, and setting to each of the sub-fields an addressing discharge period for causing the display cell selected by sequentially applying a scanning pulse to each scanning electrode, and simultaneously applying a display data pulse synchronized with the scanning pulse to each of the address electrodes to generate an addressing discharge, and a discharge sustain period for alternately applying a discharge sustain pulse to each of the discharge sustain electrodes and each of the scanning electrodes to cause each of the display cells to emit light, characterized in that the driver circuit is configured to set a potential of a second scanning base pulse applied to the scanning electrode after the end of the application of the scanning pulse lower than a potential of a first scanning base pulse applied to the scanning electrode before the application of the scanning pulse during the addressing discharge period.

A twelfth aspect of the present invention relates to the plasma display device according to the eleventh aspect of the present invention, and is characterized in that the driver circuit is configured to set the potential of the first scanning base pulse at a level for preventing a weak erroneous discharge between the scanning electrode and the address electrode, and set the potential of the second scanning base pulse at a level for forming a wall charge required for a sustain discharge at the discharge sustain electrode.

The thirteenth aspect of the present invention relates to the plasma display device according to the eleventh or twelfth aspect of the present invention, and is characterized in that the driver circuit is configured to set the potential of the first scanning base pulse or the potential of the second scanning base pulse at a different level for each of the sub-fields.

A fourteenth aspect of the present invention relates to the plasma display device according to the eleventh, twelfth, or thirteenth aspect of the present invention, and is characterized in that the driver circuit is configured to vary a potential difference between the potential of the first scanning base pulse and the potential of the second scanning base pulse in the addressing discharge period in the next sub-field based on a total number of the discharge sustain pulses in the discharge sustain period of the sub-field.

A fifteenth aspect of the present invention relates to the plasma display panel driving method according to the seventh, eighth, ninth or tenth aspect of the present invention, and is characterized in that the potential of the first scanning base pulse is set at a level for preventing a weak discharge between the scanning electrode and the address electrode, and the potential of the second scanning base pulse is set at a level for forming a wall charge required for a sustain discharge at the discharge sustain electrode, wherein the potential of said second scanning base pulse is set at the potential of said first scanning base pulse after a lapse of a constant period from a start of application of said scanning pulse.

A sixteenth aspect of the present invention relates to the plasma display panel driving method according to the seventh, eighth, ninth or tenth aspect of the present invention, and is characterized in that a period for holing said second scanning base pulse is set at a value between a horizontal scanning period and a period from a start of application of said second scanning base pulse before an end of the scanning period.

According to the configuration of the present invention, since the potential of the second scanning base pulse applied to the scanning electrode after the end of the application of the scanning pulse in the addressing discharge period is set lower than the potential of the first scanning base pulse applied to the scanning electrode before the application of the scanning pulse, a weak erroneous discharge can be suppressed between the first scanning base pulse and the display data pulse, and a potential difference is ensured between the scanning electrode and the sustain electrode, thereby making it possible to facilitate the formation of a wall charge required for a sustain discharge in the next discharge sustain period. Also, the levels of the first and second scanning base pulses in the next sub-field are set based on the total number of the discharge sustain pulses in the preceding sub-field, thereby making it possible to accomplish, with higher exactitude, the suppression of a weak erroneous discharge between the first scanning base pulse and the display data pulse, and the formation of a wall charge required for a sustain discharge in the discharge sustain period. Therefore, the present invention can provide a high definition of displayed image, and significantly improve the productivity.

The present invention provides a plasma display device having a high definition of displayed image by setting the potential of a scanning base pulse applied to a scanning electrode after the end of the application of a scanning pulse in an addressing discharge period lower than the potential of a scanning base pulse applied to the scanning electrode before the application of the scanning pulse.

In cases where the driving waveform excluding the priming period Tp is use, generation of weak discharge is suppressed by limiting the scanning base pulse period after the application of the scanning pulses, which would be a cause of the weak discharge in the preceding sub-field between the scanning electrode and address electrodes.

DETAILED DESCRIPTION OF THE INVENTION

Figure 10:
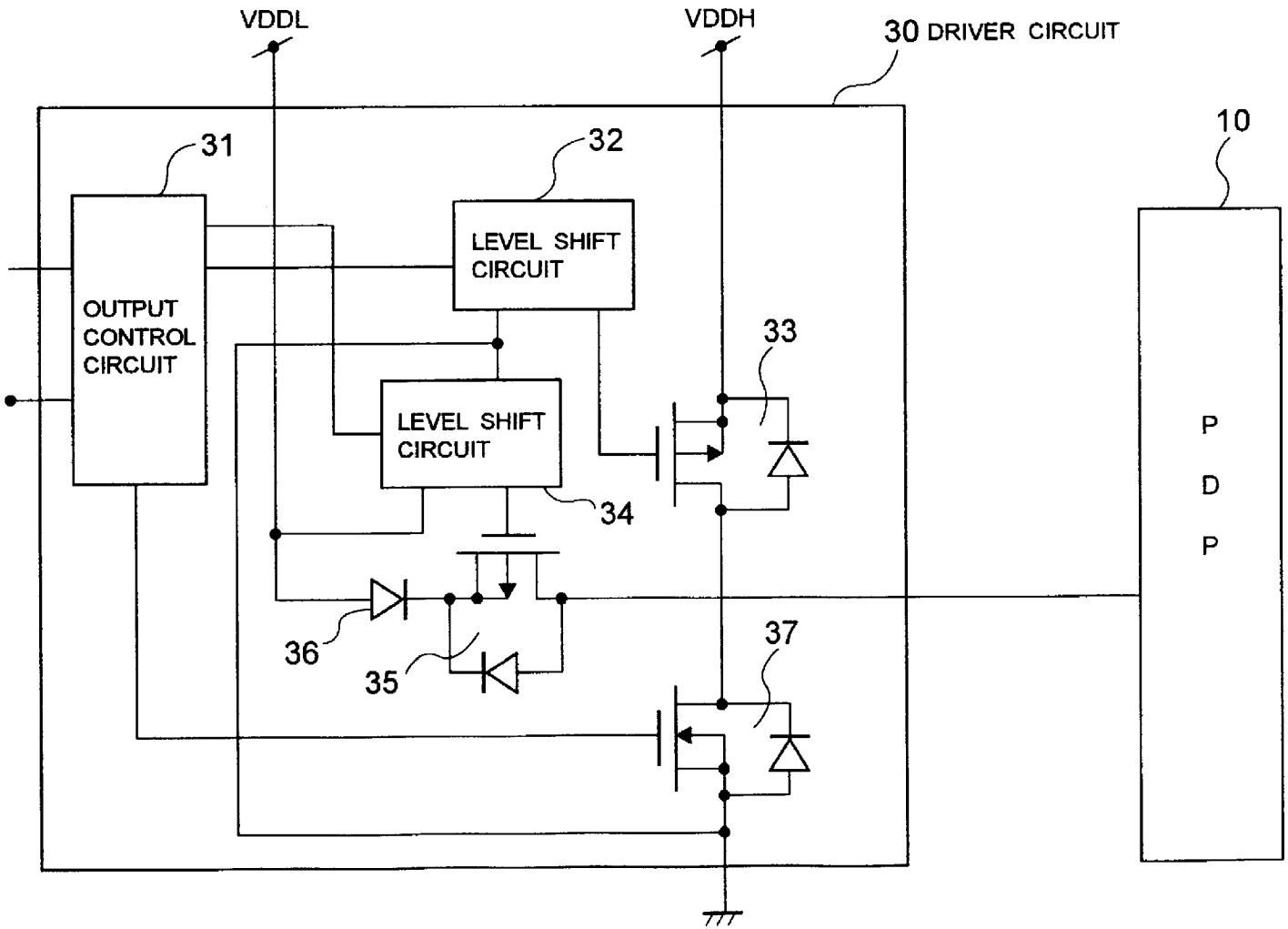
FIG. 10 is a block diagram showing the electric configuration of a main portion of a driver circuit for a plasma display device according to one embodiment of the present invention.

FIG. 10 is a block diagram showing the electric configuration of a main portion of a driving circuit for a plasma display device according to a first embodiment of the present invention.

Figure 1:
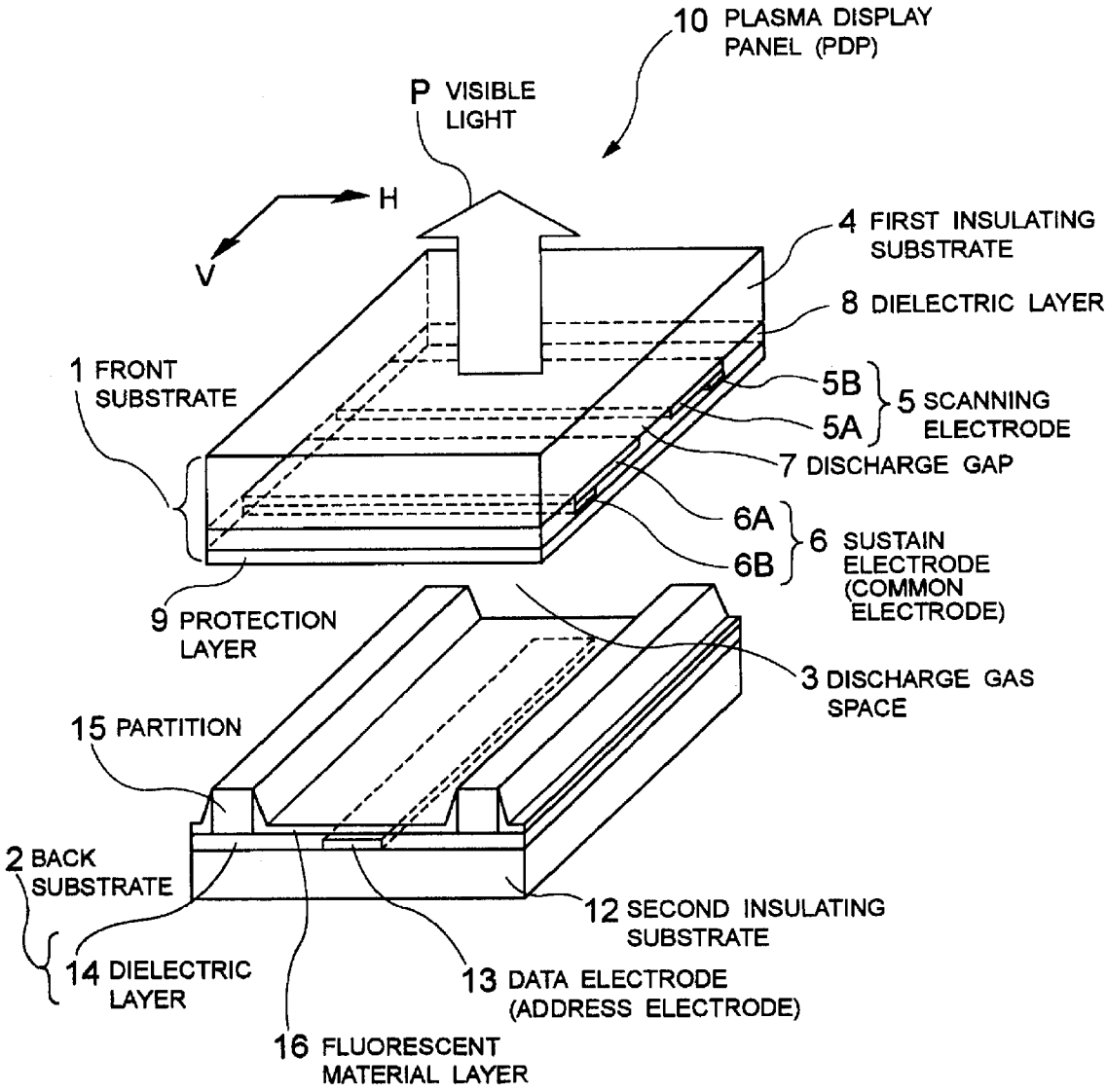
FIG. 1 is a diagram for explaining the structure of a PDP.
Figure 2:
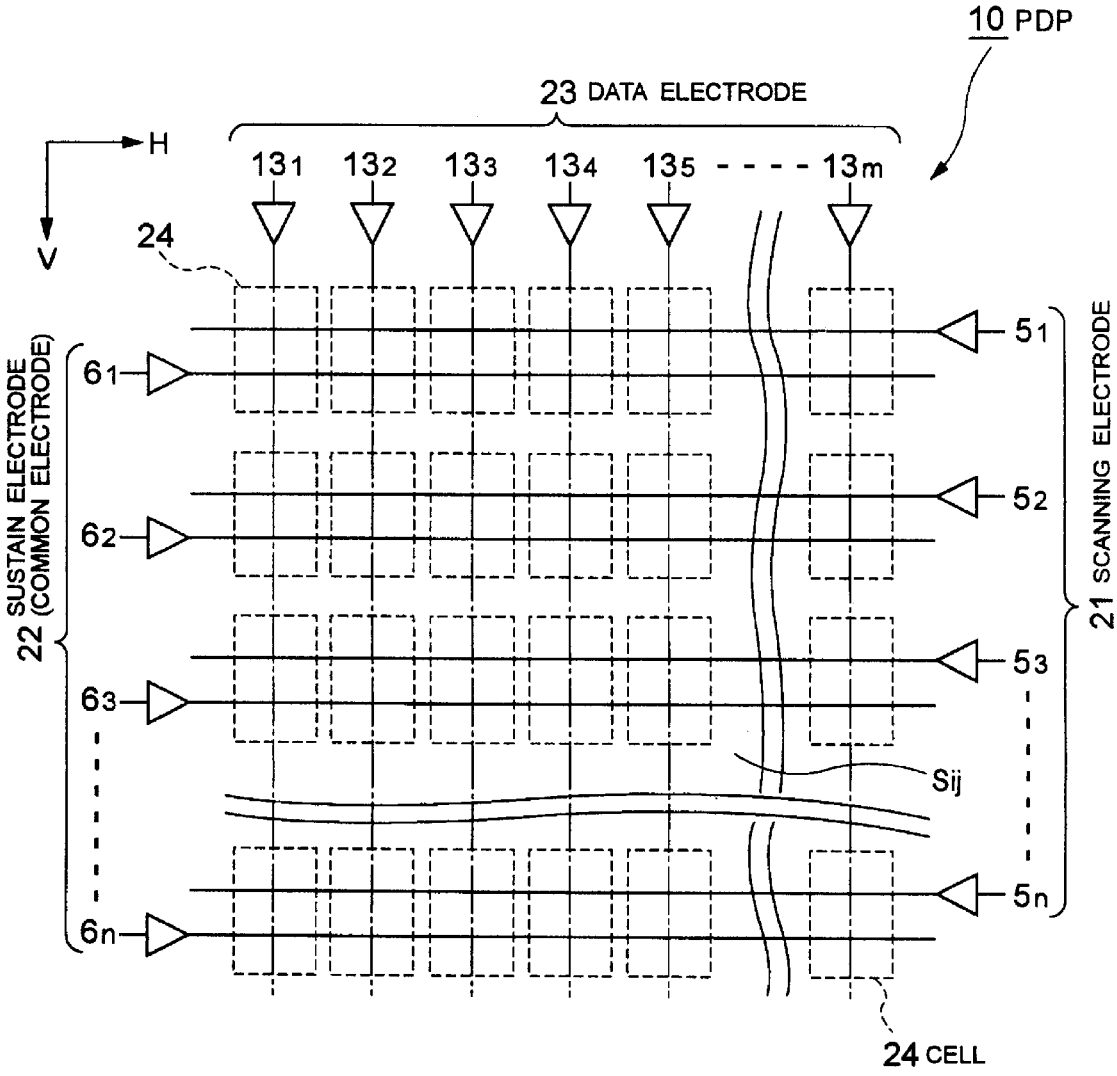
FIG. 2 is a diagram showing the layout of electrodes of the PDP 10.
Figure 3:
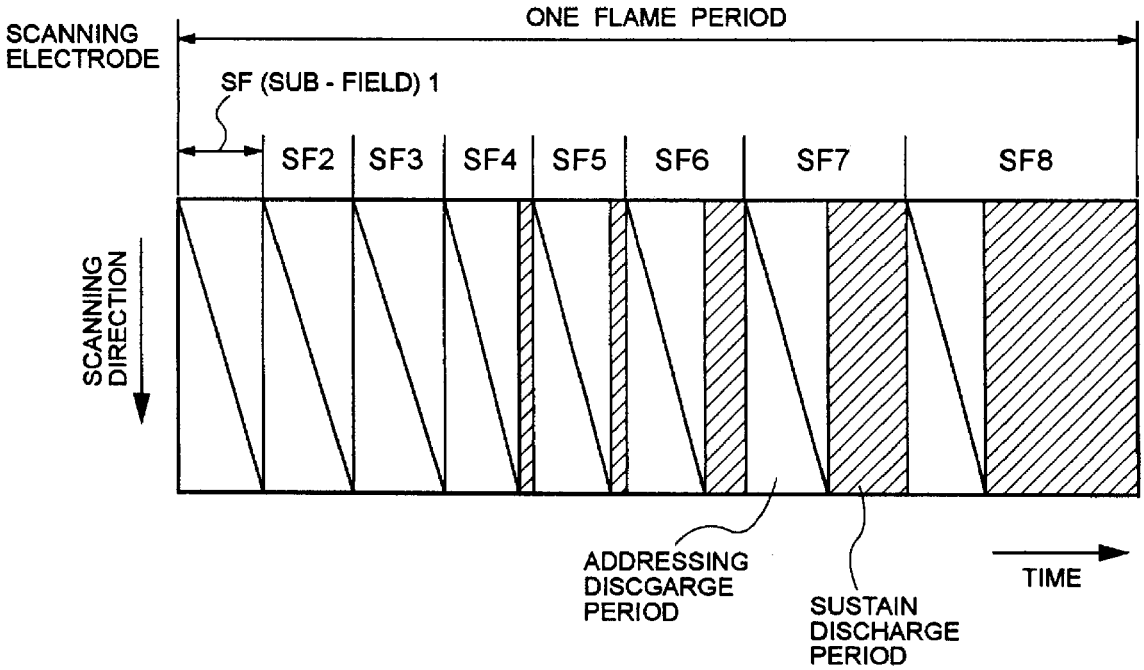
FIG. 3 is a diagram for explaining the principle of a gradation display method.
Figure 4:
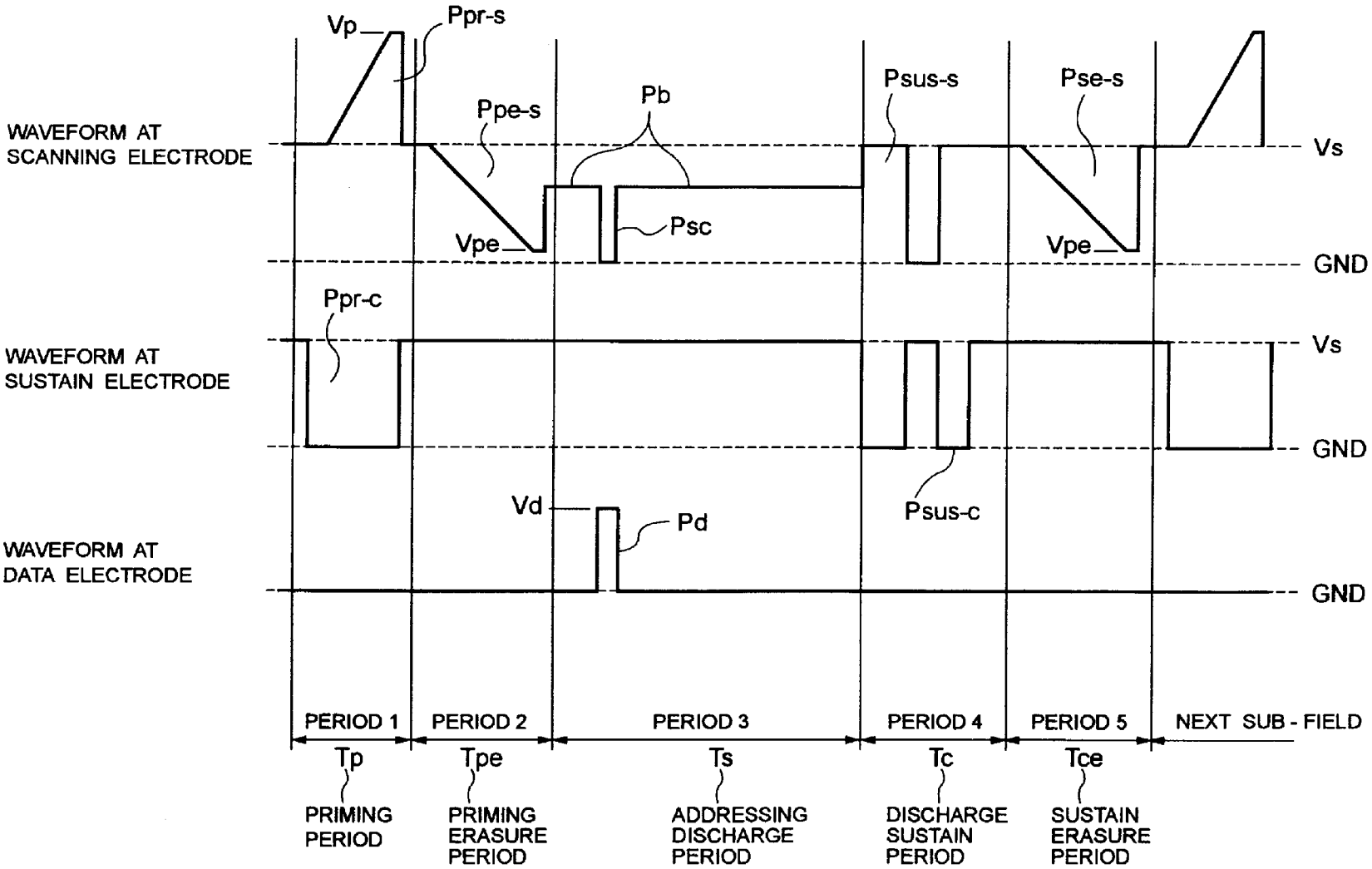
FIG. 4 is a diagram showing exemplary driving waveforms in one sub-field in FIG. 3.
Figure 5:
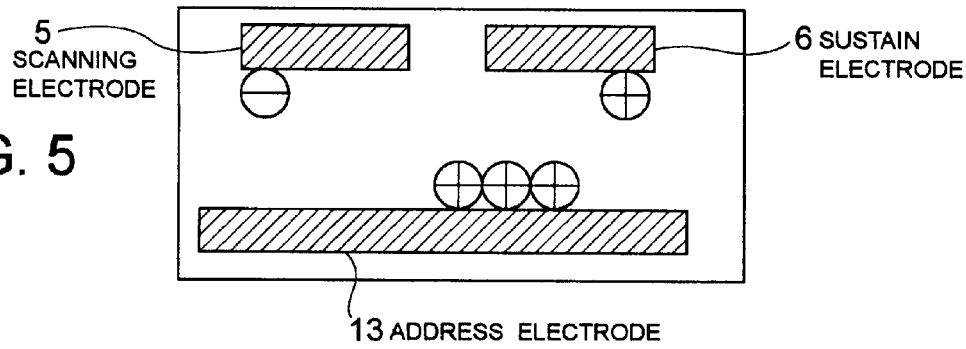
FIG. 5 is a diagram showing the state of wall charges on a scanning electrode 5, a sustain electrode 6, and an address electrode 13 immediately before an addressing discharge period Ts when the driving waveforms shown in FIG. 4 are used.
Figure 6:
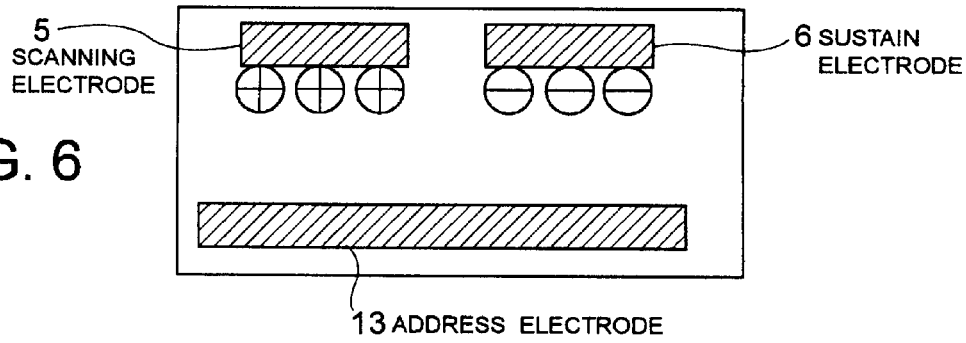
FIG. 6 is a diagram showing the state of wall charges on the scanning electrode 5, sustain electrode 6, and address electrode 13 immediately after the addressing discharge period Ts when the driving waveforms shown in FIG. 4 are used.
Figure 7:
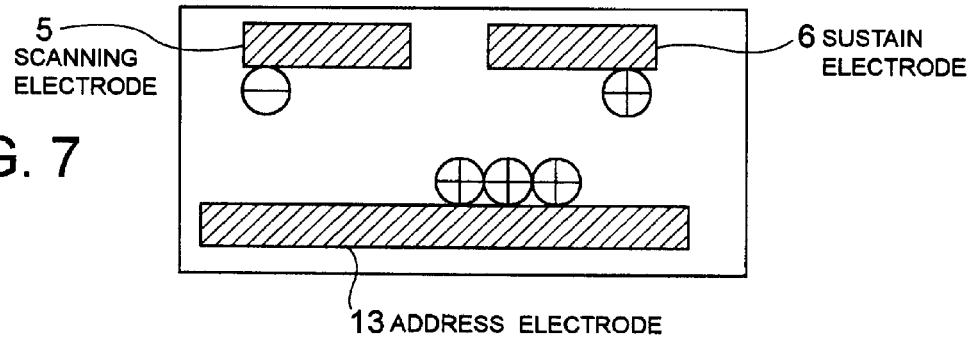
FIG. 7 is a diagram showing the state of wall charges on the scanning electrode 5, sustain electrode 6, and address electrode 13 in a cell which is not applied with a display data pulse Pd.
Figure 8:
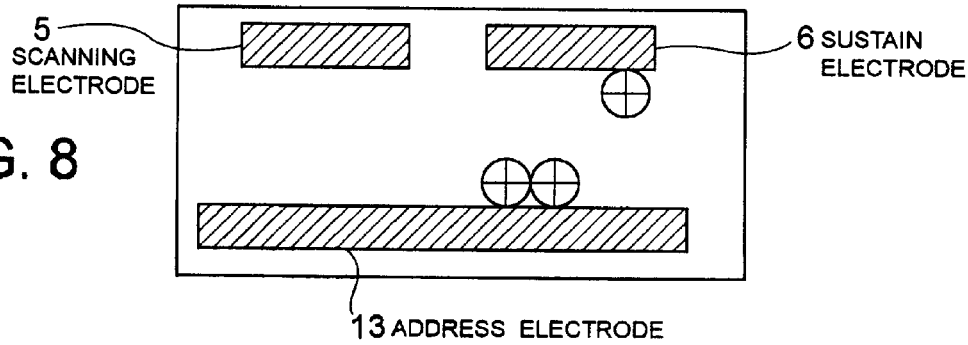
FIG. 8 is a diagram showing the state of wall charges on the scanning electrode 5, sustain electrode 6, and address electrode 13 when a weak erroneous discharge is produced when the driving waveforms shown in FIG. 4 are used.
Figure 9:
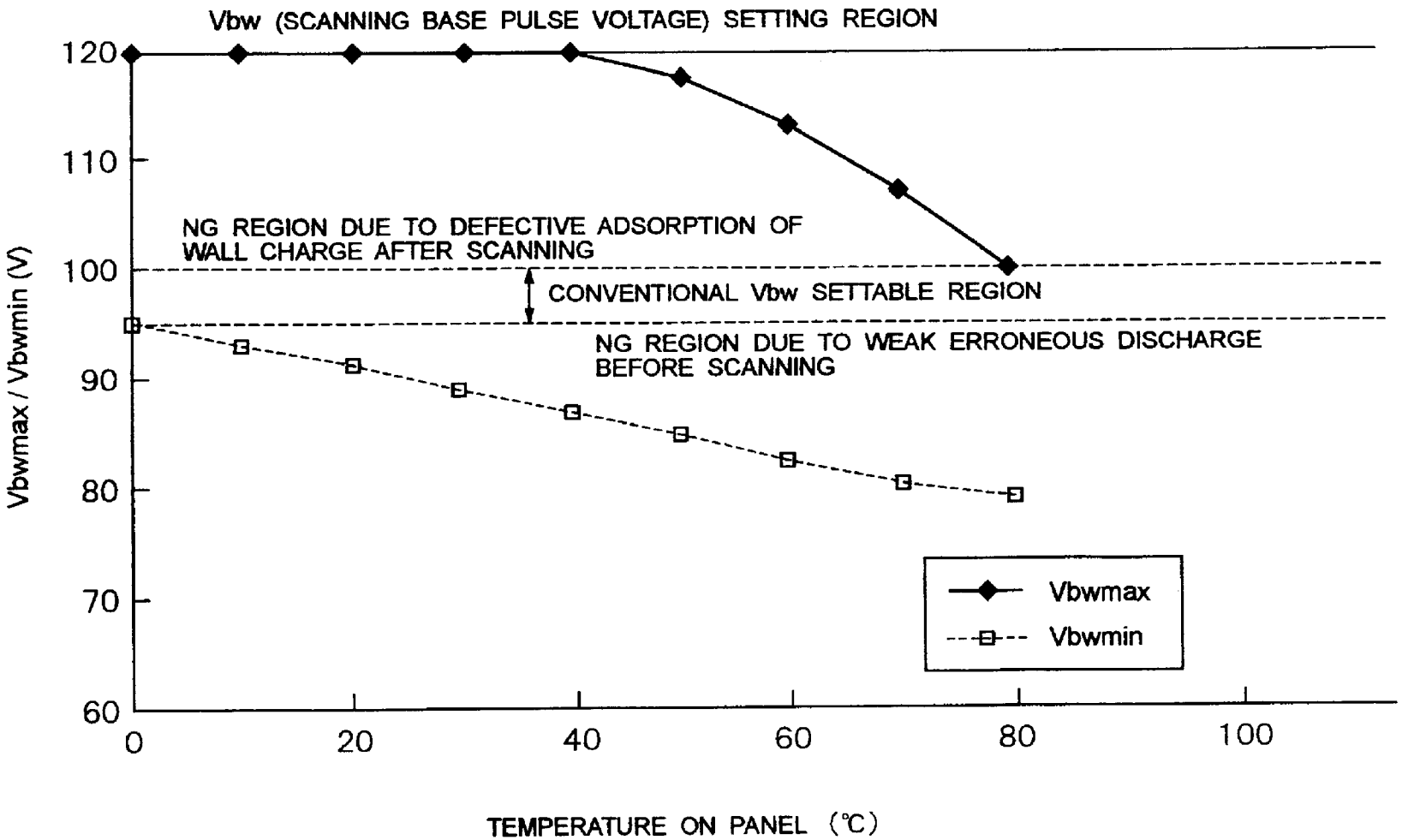
FIG. 9 is a diagram for explaining a range in which the level of a conventional scanning base pulse Pd is set.

As shown in FIG. 10, the driver circuit 30 in this embodiment comprises a control circuit 31, a level shift circuit 32, a p-channel MOS transistor (hereinafter called the "pMOS") 33, a level shift circuit 34, a pMOS 45, a diode 36, and an n-channel MOS transistor (hereinafter called the "nMOS") 37. This driver circuit 30 is connected to one of scanning electrodes 5 of a PDP 10 shown in FIG. 6. The output control circuit 31 controls switching operations of the pMOS 33, pMOS 35, and nMOS 37.

The level shift circuit 32 generates a gate voltage for causing the pMOS 33 to perform a switching operation under the control of the output control circuit 31. The pMOS 33 performs a switching operation based on a gate voltage applied from the level shift circuit 32, and transmits a power supply potential VDDH from the source to the drain, when it is on, to output a scanning base pulse Pb. The power supply potential VDDH is set at the level of the scanning base pulse Pb which is applied to the scanning electrode before the application of a scanning pulse in an addressing discharge period. The level shift circuit 34 generates a gate voltage for causing the pMOS 35 to perform a switching operation under the control of the output control circuit 31.

The pMOS 35 performs a switching operation based on the gate voltage applied from the level shift circuit 34, and transmits the power supply potential VDDL (VDDL<VDDH), when it is on, to output a scanning base pulse Pb. The power supply potential VDDL is set at the level of the scanning base pulse Pb applied to the scanning electrode after the end of the application of the scanning pulse in the addressing discharge period. The diode 36 prevents a current from the power supply potential VDDH to the power supply potential VDDL from flowing in the reverse direction. The nMOS 37 performs a switching operation based on the gate voltage applied from the output control circuit 31, and transmits a potential applied to the source (the ground level in this embodiment) when it is on to the drain. This potential defines the level of the scanning pulse.

Figure 11:
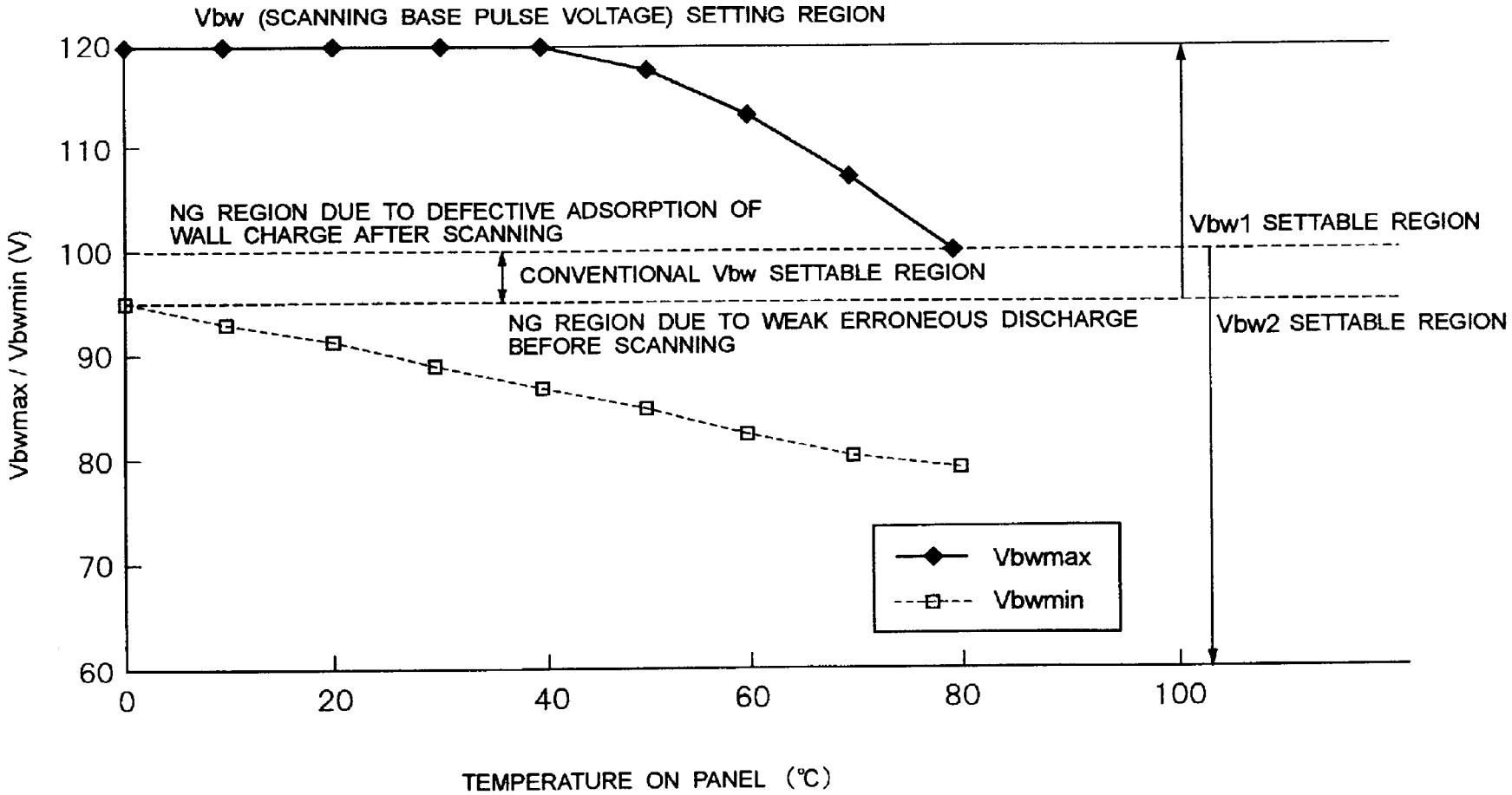
FIG. 11 is a diagram for explaining a range in which the level of the scanning base pulse Pb is set in the driver circuit 30 in FIG. 10.

FIG. 11 is a diagram for explaining a range in which the level of the scanning base pulse Pb is set in the driver circuit 30.

By independently controlling the level of the scanning base pulse Pb before and after the application of the scanning pulse, a level Vbw1 of the scanning base pulse Pb before scanning, and a level Vbw2 of the scanning base pulse Pb after scanning can be set in respective ranges indicated by arrows to relatively readily ensure margins.

Specifically, for controlling the level Vbw1 of the scanning base pulse Pb before scanning, a weak erroneous discharge is more likely to be produced between the scanning electrode 5 and the address electrode 13 before scanning as there are a larger number of discharge sustain pulses in the preceding sub-field, so that a lower limit for the set potential of the scanning base pulse Pb becomes higher before scanning of a current sub-field. On the other hand, an upper limit for the set potential of the scanning base pulse Pb before scanning is determined by a breakdown of a driver. Therefore, in order to ensure a range as wide as possible for the breakdown of the driver, the scanning base pulse Pb is set at a higher potential when there is a large number of discharge sustain pulses in the preceding sub-field, while the scanning base pulse Pb is set at a lower potential when there is a small number of discharge sustain pulses in the preceding sub-field.

On the other hand, for controlling the level Vbw2 of the scanning pulse Pb after scanning, conventionally, the width of the scanning pulse Psc is reduced to ensure a discharge sustain time when there are a large number of discharge sustain pulses in a current sub-field, and the width of the scanning pulse Psc is increased when there are a small number of discharge sustain pulses in the current sub-field, to ensure the formation of wall charges. Bearing the foregoing in mind, the scanning base pulse Pb is set at a low potential after scanning, when there are a large number of discharge sustain pulses in the current sub-field and the width of the scanning pulse Psc is narrow, in order to facilitate the formation of a wall charge required for the sustain electrode 6 after scanning. On the other hand, the scanning base pulse Pb is set at a high potential after scanning to prevent a weak erroneous discharge between the scanning electrode 5 and the address electrode 13, when there are a small number of sustain pulses in the current sub-field and the width of the scanning pulse Psc is wide, because the wall charge can be relatively readily formed.

Figure 12:
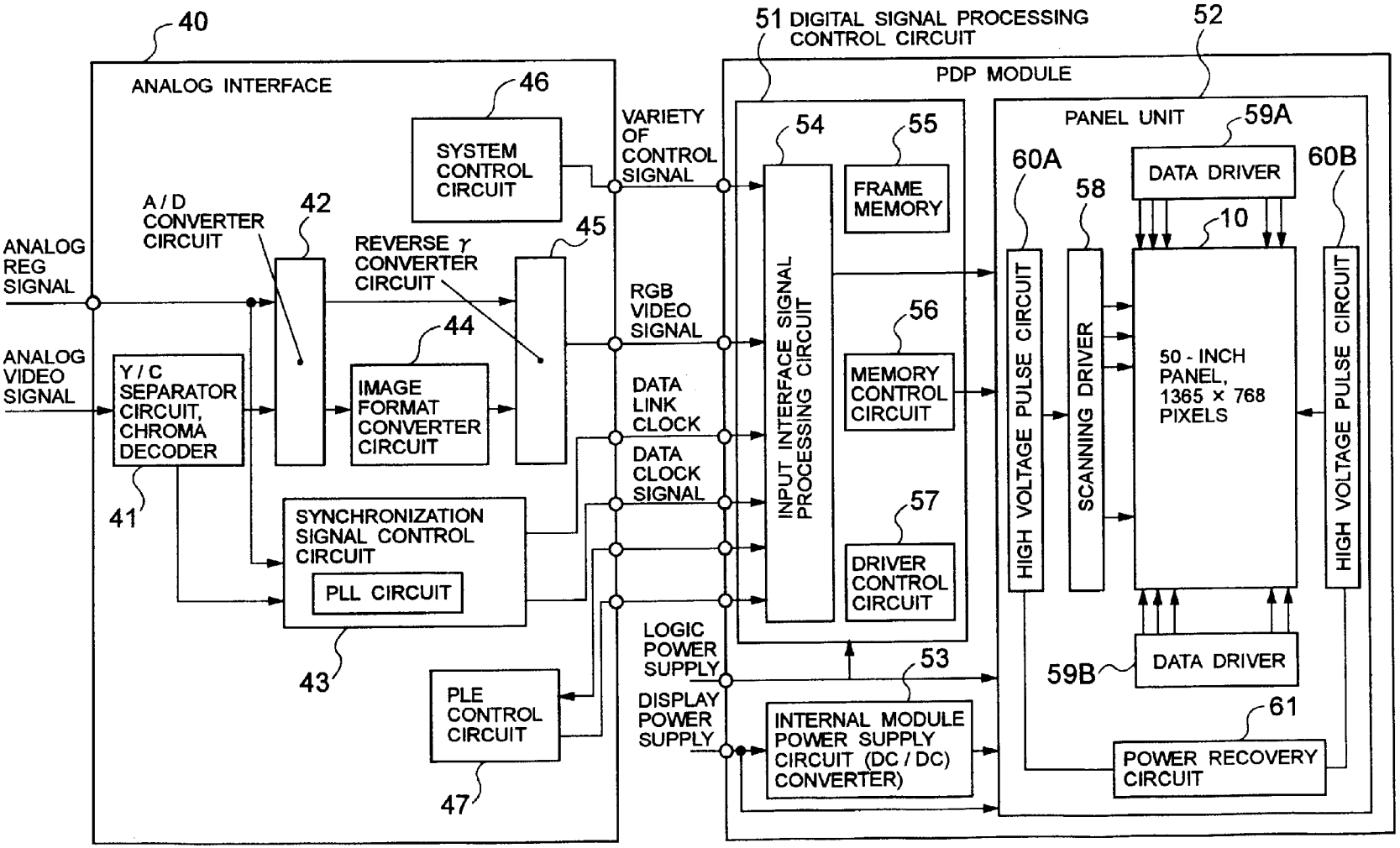
FIG. 12 is a block diagram generally showing an exemplary electric configuration of a plasma display for use with the driving circuit 30 and PDP 10 in FIG. 10.

FIG. 12 is a block diagram generally showing an exemplary electric configuration of a plasma display device for use with the driver circuit 30 and PDP 10 in FIG. 10.

This plasma display device comprises an analog interface 40 and a PDP module 50. The analog interface 40 comprises a Y/C (luminance/color) separator circuit 41 including a chroma decoder; an A/D (analog-to-digital) converter circuit 42; a synchronization signal control circuit 43 having a PLL (phase locked loop) circuit; an image format converter circuit 44; a reverse γ converter circuit 45; a system control circuit 46; and a PLE (Peak Luminance Enhancement) control circuit 47. The PDP module 50 comprises a digital signal processing control circuit 51; a panel unit 52; and an internal module power supply circuit 53 which contains a DC/DC converter. The digital signal processing control circuit 51 comprises an input interface signal processing circuit 54, a frame memory 55, a memory control circuit 56, and a driver control circuit 57.

The panel unit 52 comprises the PDP 10; a scanning driver 58 for driving scanning electrodes 5 of the PDP 10; data drivers 59A, 59B for driving data electrodes 13; high voltage pulse circuits 60A, 60B for supplying pulse voltages to the PDP 10 and scanning driver 58; and a power recovery circuit 61 for recovering surplus power generated in the high voltage pulse circuits 60A, 60B. The driver circuit 30 in FIG. 10 forms part of the aforementioned scanning driver 58.

In this plasma display device, generally, an input analog video signal is converted to a digital video signal by the analog interface 40, and the digital video signal is supplied to the PDP module 50. For example, an analog video signal output from a television tuner, not shown, or the like is separated into luminance signals of R, G, B colors by the Y/C separator circuit 21, and then converted to a digital video signal by the A/D converter circuit 42. Subsequently, when the digital video signal differs from the PDP module 50 in the pixel layout, the digital video signal is converted to an image format, which is supported by the PDP module 50, by the image format converter circuit 44.

The characteristic of a display luminance to an input signal of the PDP 10 is linearly proportional, but a normal video signal has been previously corrected (γ conversion) in accordance with the characteristics of a CRT. Thus, after an analog video signal is A/D converted in the A/D converter circuit 42, a reverse γ conversion is performed in the reverse y converter circuit 45. This reverse y conversion generates a digital video signal which has recovered the linear characteristic. This digital video signal is output to the PDP module 50 as R, G, B video signals.

Since an analog video signal does not include a sampling clock for A/D conversion or a data clock signal, a PLL circuit contained in the synchronization signal control circuit 43 generates a sampling clock and a data clock signal based on a horizontal synchronization signal supplied simultaneously with the analog video signal, and outputs the sampling clock and data clock signal to the PDP module 50. Also, the PLE control circuit 47 of the analog interface 40 controls the luminance for the PDP module 50. Specifically, the display luminance is increased when an average luminance level is equal to or lower than a predetermined value, and the display luminance is reduced when the average luminance level exceeds the predetermined value. The PLE control circuit 47 sets luminance control data in accordance with the average luminance level, and sends the luminance control data to a luminance level control circuit, not shown, in the input interface signal processing circuit 54.

The system control circuit 46 sends a variety of control signals to the PDP module 50. For example, an average luminance level of R, G, B video signals input to the input interface signal processing circuit 54 is calculated by an input signal average luminance level calculating circuit, not shown, in the input interface signal processing circuit 54, and is output, for example, as 5-bit data. In the digital signal processing control circuit 51, after the variety of signals are processed by the input interface signal processing circuit 54, the control signals are sent to the panel unit 52. Simultaneously, a memory control signal and a driver control signal are sent to the panel unit 52 from the memory control circuit 56 and driver control circuit 57, respectively.

The PDP 10 has, for example, 1365×768 pixels. In the PDP 10, the scanning driver 58 controls the scanning electrodes, and the data driver 59 controls the data electrodes, to control these pixels to turn on or off predetermined pixels, thus providing a display corresponding to the R, G, B video signals. A logic power supply supplies logic power to the digital signal processing control circuit 51 and panel unit 52. Also, DC power is supplied from a display power supply to the internal module power supply circuit 53, and is converted to a predetermined voltage before it is supplied to the panel unit 52.

Figure 13:
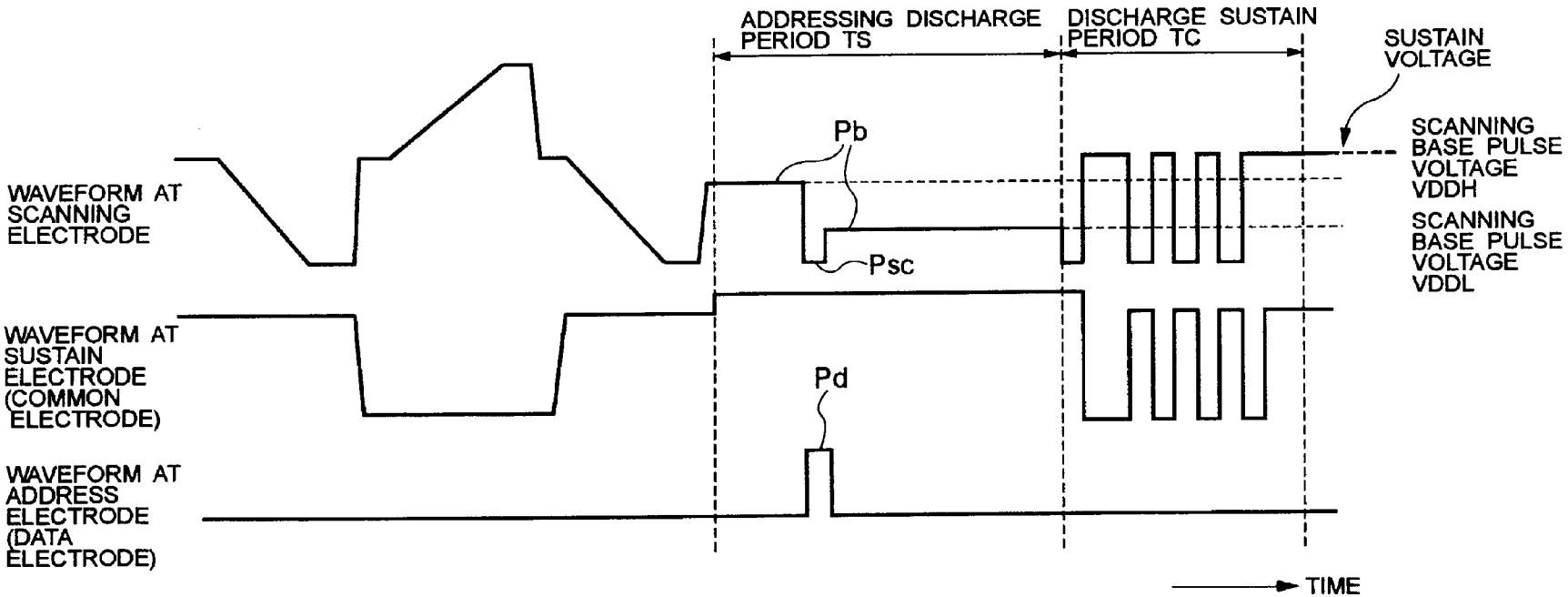
FIG. 13 is a time chart of signals at respective components for explaining the operation of the driving circuit 30 in FIG. 10.

FIG. 13 is a time chart of signals at respective components of the driver circuit 30 for explaining the operation thereof, wherein the vertical axis represents the voltage, and the horizontal axis represents the time.

The contents of processing in the method of driving a plasma display device according to this embodiment will be described with reference to FIG. 13.

First, in the driver circuit 30, in the initial state in an addressing discharge period Ts, the nMOS 37 and pMOS 35 are turned off, while the pMOS 33 is turned on under the control of the output control circuit 31. Therefore, the scanning electrode of the PDP is applied with the scanning base pulse Pb at the level of the potential VDDH. This suppresses a weak erroneous discharge between the scanning base pulse Pb and the display data pulse Pd. Also, with the provision of the diode 36 for preventing a reverse flow, no current will flow from the power supply voltage VDDH to the power supply voltage VDDL.

Next, the nMOS 37 is turned on, while the pMOS transistors 33, 35 are turned off under the control of the output control circuit 31. This causes the scanning electrode 5 to be applied with the scanning pulse Psc at the ground level. After the scanning pulse Psc has been applied, the pMOS 35 is turned on, while the nMOS 37 and pMOS are turned off, causing the scanning electrode 5 to be applied with the scanning base pulse Pb at the level of the potential VDDL. In this way, the level of the scanning base pulse Pb applied to the scanning electrode 5 after the end of the application of the scanning pulse Psc in the addressing discharge period Ts is lower than the level of the scanning base pulse Pb applied to the scanning electrode 5 before the application of the scanning pulse Ps. This ensures a potential difference between the scanning electrode 5 and the sustain electrode 6 to facilitate the formation of a wall charge required for a sustain discharge in the next discharge sustain period Tc.

As described above, in the first embodiment, the scanning electrode 5 is applied with the scanning base pulse Pb at the level of the potential VDDH in the initial state in the addressing discharge period Ts, so that a weak erroneous discharge is suppressed between the scanning base pulse Pb and display data pulse Pd. Also, the scanning electrode 5 is applied with the scanning base pulse Pb at the level of the potential VDDL after the scanning pulse Psc has been applied, so that a potential difference is ensured between the scanning electrode 5 and the sustain electrode 6, thereby facilitating the formation of a wall charge which is required for a sustain discharge in the next discharge sustain period Tc. Consequently, a high definition of display image can be provided.

Figure 14:
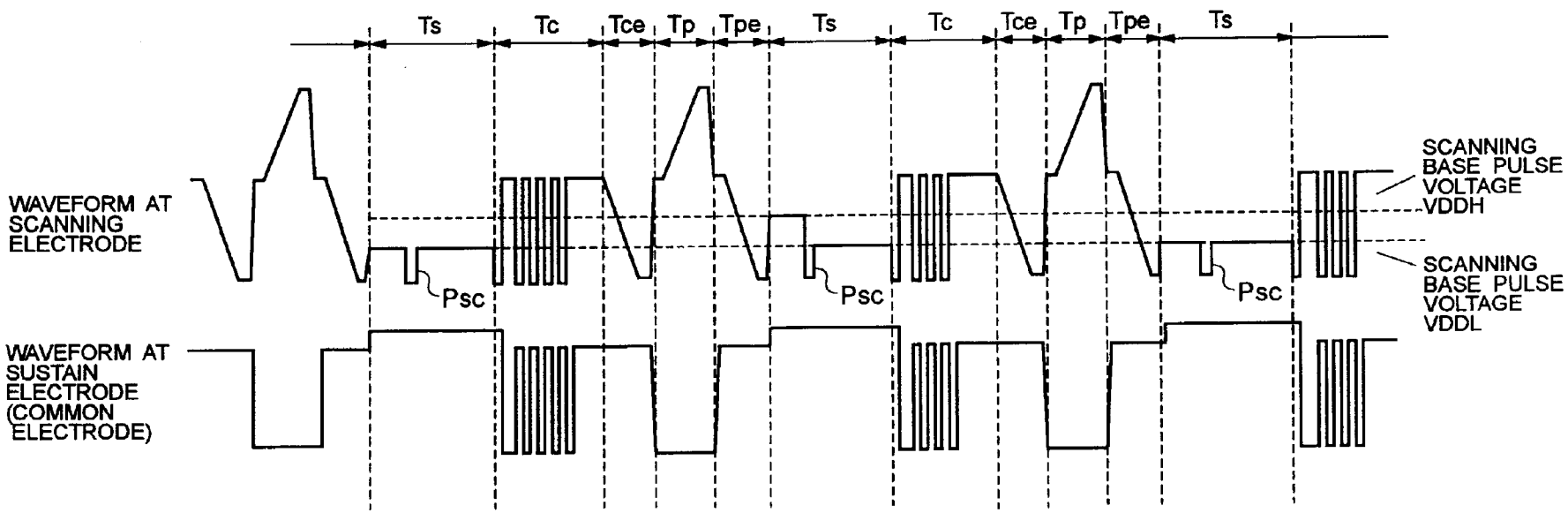
FIG. 14 is a time chart for explaining a plasma display device driving method according to a second embodiment of the present invention.

FIG. 14 is a time chart for explaining a method of driving a plasma display device according to a second embodiment of the present invention.

In this exemplary driving method, the driver circuit 30 in FIG. 10 is configured to vary a potential difference between the potential of the first scanning base pulse Pb in the addressing discharge period Ts of the next sub-field and the potential of the second scanning base pulse Pb based on a total number (i.e., a weight of the sub-field) in the discharge sustain pulses in the discharge sustain period Tc of the sub-field. Specifically, since the characteristics of a weak erroneous discharge between the scanning electrode 5 and the address electrode 13 vary due to the number of times of the sustain discharges in the preceding sub-field, the presence or absence of a reset period, and the like, the scanning base pulse Pb is set at an optimal level even when these parameters vary. Specifically, as there are a larger number of discharge sustain pulses in the preceding sub-field, the scanning base pulse Pb is set at a higher potential in the next sub-field. Consequently, the driving method shown in the first embodiment and conventional driving method are switched depending on the weight (the total number of discharge sustain pulses) of a sub-field to increase a voltage range in which the scanning base pulse is set.

As described above, in the second embodiment, the scanning base pulse Pb in the next sub-field is set at a level based on the total number of discharge sustain pulses in the preceding sub-field, so that the second embodiment more precisely carries out the suppression of a weak erroneous discharge between the scanning base pulse Pb and the display data pulse Pd, and the formation of a wall charge required for a sustain discharge in the discharge sustain period Tc.

Figure 15:
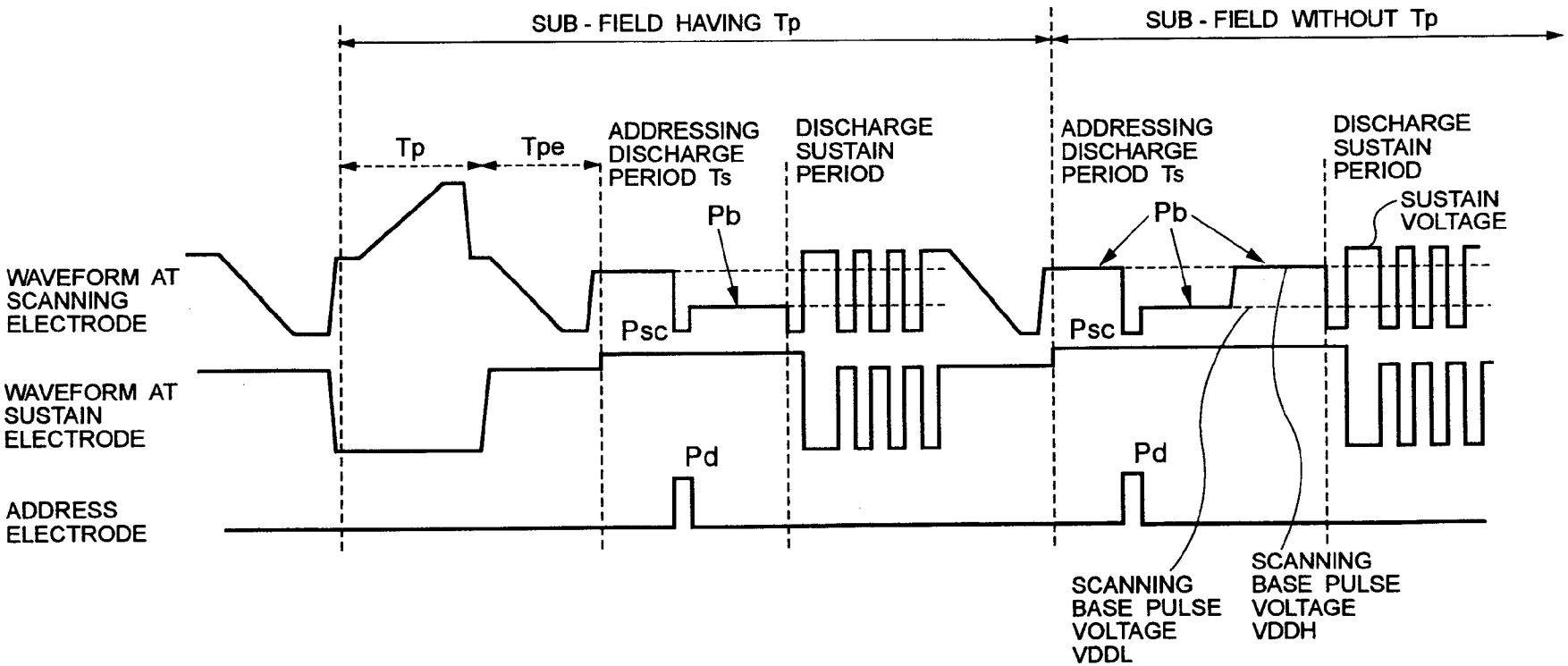
FIG. 15 is a time chart for explaining a plasma display device driving method according to a third embodiment of the present invention.

FIG. 15 shows a drive waveform in the third embodiment of the present invention in which a drive scheme without provision of a priming period Tp is adopted. With the drive waveform in which the priming period is excluded, light emission of a discharge cell in a sub-field can be failed because a weak discharge between the scanning electrode and the address electrode in a preceding sub-field may not be reset due to the lack of a reset period.

In order to cope with this problem, the potential of the scanning electrode is raised to the first scanning base pulse after the lapse of a constant period, so that the weak discharge between the scanning electrode and the address electrode in a preceding sub-field is suppressed.

In order to determine the period to hold the second scanning base pulse, experiments have been performed with different values of the holding period. It has been confirmed that the generation of the weak discharge can be suppressed by securing the period described below as the period for holding the second scanning base pulse after the end of application of the scanning pulses, and subsequently raising the potential to the potential of first scanning base pulse. Specifically the period is selected to be more than one horizontal scanning period (corresponding to a period of the width of the scanning pulse Psc) but less than a period to the end of the scanning period.

More concretely, the applicants have confirmed that the weak discharge is prevented if the period for holding the second scanning base pulse is set to be longer than 2 micro seconds, but shorter than a period from the end of application of the scanning base pulse to the end of the scanning period.

While embodiments of the present invention have been described in detail with reference to the drawings, the specific configuration is not limited to the foregoing embodiments, and if there are modifications in design and the like without departing from the spirit and scope of the invention, they are included in the present invention as well.

For example, while in the foregoing embodiments, the potential of the scanning pulse Psc is set at the ground level, it may be set at a negative voltage. Also, the respective MOS transistors in the driver circuit 30 may be replaced with bipolar transistors, IGBT (Insulated Gate Bipolar Transistor) devices, and the like. Also, while the foregoing embodiments have set the level of the scanning base pulse Pb at two values before and after the application of the scanning pulse Psc, the level may be set at three values or more such that the scanning base pulse Pb is set at a different level in each sub-field. However, in this configuration, the driver circuit 30 should be configured to set the level of the scanning base pulse Pb at three values or more.

This application is based on Japanese Patent Application No. 2003-406560 which is herein incorporated by reference.

What is claimed is:

1. A plasma display panel driving method for use with a plasma display panel comprising a first substrate and a second substrate disposed in opposition to each other; a plurality of surface discharge electrode pairs each comprised of a scanning electrode and a discharge sustain electrode disposed on a surface of the first substrate opposing the second substrate and extended in parallel with each other across a discharge gap; a plurality of address electrodes disposed on the surface of the second substrate opposing the first substrate in a form perpendicular to each of the surface discharge electrode pairs; and a plurality of display cells each formed at each of intersection areas of the plurality of surface discharge electrode pairs with the plurality of address electrodes, the method comprising:

dividing one frame period of a display image displayed in gradations by the plurality of display cells into a plurality of sub-fields weighted based on gradation levels, and setting to each of the sub-fields an addressing discharge period for causing the display cell selected by sequentially applying a scanning pulse to each scanning electrode, and simultaneously applying a display data pulse synchronized with the scanning pulse to each of the address electrodes to generate an addressing discharge, and a discharge sustain period for alternately applying a discharge sustain pulse to said each discharge sustain electrode and said each scanning electrode to cause said each display cell to emit light, wherein said addressing discharge period includes a period in which a potential of a second scanning base pulse that is applied to said scanning electrode after the application of said scanning pulse has finished is set lower than a potential of a first scanning base pulse that is applied to said scanning electrode before the application of said scanning pulse.

2. A plasma display panel driving method as claimed in claim 1, wherein a difference between potentials of a first scanning base pulse that is applied to said scanning electrode before the application of said scanning pulse in said addressing discharge period and a second scanning base pulse that is applied to said scanning electrode after the application of said scanning pulse has finished, in said addressing discharge period in a subsequent subfield, is varied based on a total number of discharge sustain pulses in the discharge sustain period of a current subfield, while satisfying a condition: a potential of said first sustain base pulse a potential of said second sustain base pulse.

3. A plasma display panel driving method as claimed in claim 2, wherein said potential difference between potentials of said first and second scanning base pulses is set larger as the total number of the discharge sustain pulses increases.

4. A plasma display panel driving method as claimed in claim 1, wherein after a lapse of a holding period from an end of application of said scanning pulse, said potential of said second scanning base pulse is set at a potential identical with a potential of said first scanning base pulse in a period which the potential of said first scanning base pulse is set higher than the potential of said second scanning base pulse.

5. A plasma display panel driving method as claimed in claim 4, wherein the potential of said first scanning base pulse is set at a level for preventing a weak discharge between said scanning electrode and said address electrodes, and the potential of said second scanning base pulse is set at a level for forming a wall charge required for a sustain discharge at said discharge sustain electrode.

6. A plasma display device comprising:

a plasma display panel comprising a first substrate and a second substrate disposed in opposition to each other; a plurality of surface discharge electrode pairs each comprised of a scanning electrode and a discharge sustain electrode disposed on a surface of said first substrate opposing said second substrate and extended in parallel with each other across a discharge gap; a plurality of address electrodes disposed on the surface of said second substrate opposing said first substrate in a form perpendicular to said each surface discharge electrode pair; and a plurality of display cells each formed at each of intersection areas of said plurality of surface discharge electrode pairs with said plurality of address electrodes; and a driver circuit for dividing one frame period of a display image displayed in gradations by said plurality of display cells into a plurality of sub-fields weighted based on gradation levels, and setting said each sub-field to an addressing discharge period for causing said display cell selected by sequentially applying a scanning pulse to each scanning electrode, and simultaneously applying a display data pulse synchronized with said scanning pulse to said each address electrode to generate an addressing discharge, and a discharge sustain period for alternately applying a discharge sustain pulse to said each discharge sustain electrode and said each scanning electrode to cause said each display cell to emit light, wherein said driver circuit is configured to render said addressing discharge period to include a period in which a potential of a second scanning base pulse that is applied to said scanning electrode after the application of said scanning pulse has finished is set lower than a potential of a first scanning base pulse that is applied to said scanning electrode before the application of said scanning pulse.

7. A plasma display device as claimed in claim 6, wherein a difference between potentials of a first scanning base pulse that is applied to said scanning electrode before the application of said scanning pulse in said addressing discharge period and a second scanning base pulse that is applied to said scanning electrode after the application of said scanning pulse has finished, in said addressing discharge period in a subsequent subfield, is varied based on a total number of discharge sustain pulses in the discharge sustain period of a current subfield, while satisfying a condition; a potential of said first sustain base pulse~a potential of said second sustain base pulse.

8. A plasma display device as claimed in claim 7, wherein said potential difference between potentials of said first and second scanning base pulses is set larger as the total number of the discharge sustain pulses increases.

9. A plasma display device as claimed in claim 6, wherein after a lapse of a holding period from an end of application of said scanning pulse, said potential of said second scanning base pulse is set at a potential identical with a potential of said first scanning base pulse in a period in which the potential of said first scanning base pulse is set higher than the potential of said second scanning base pulse.

10. A plasma display device as claimed in claim 9, wherein the potential of said first scanning base pulse is set at a level for preventing a weak discharge between said scanning electrode and said address electrodes, and the potential of said second scanning base pulse is set at a level for forming a wall charge required for a sustain discharge at said discharge sustain electrode.

* * * * *